US010995944B2

(12) United States Patent
Tschager et al.

(10) Patent No.: US 10,995,944 B2
(45) Date of Patent: May 4, 2021

(54) ILLUMINATION MODULE FOR EMITTING LIGHT DIRECTED IN PARALLEL

(71) Applicant: LITEstudio OG, Vienna (AT)

(72) Inventors: Michael Tschager, Mauerbach (AT); Thomas Welz, Vienna (AT)

(73) Assignee: LITEstudio OG, Vienna (AT)

( * ) Notice: Subject to any disclaimer, the term of this patent is extended or adjusted under 35 U.S.C. 154(b) by 0 days.

(21) Appl. No.: 16/649,296

(22) PCT Filed: Sep. 12, 2018

(86) PCT No.: PCT/AT2018/060208
§ 371 (c)(1),
(2) Date: Mar. 20, 2020

(87) PCT Pub. No.: WO2019/056032
PCT Pub. Date: Mar. 28, 2019

(65) Prior Publication Data

US 2020/0292162 A1 Sep. 17, 2020

(30) Foreign Application Priority Data

Sep. 21, 2017 (AT) ..... A 50800/2017

(51) Int. Cl.
*F21V 29/51* (2015.01)
*F21V 29/71* (2015.01)
(Continued)

(52) U.S. Cl.
CPC ..... *F21V 29/51* (2015.01); *F21S 2/005* (2013.01); *F21S 6/007* (2013.01); *F21V 3/02* (2013.01);
(Continued)

(58) Field of Classification Search
CPC ..... F21V 29/51; F21V 29/713; F21V 29/767; F21V 9/30; F21V 3/02; F21V 7/0008;
(Continued)

(56) References Cited

U.S. PATENT DOCUMENTS

2006/0124953 A1* 6/2006 Negley ..... H01L 33/486 257/99
2010/0302777 A1* 12/2010 Knoll ..... F21S 41/151 362/235
(Continued)

FOREIGN PATENT DOCUMENTS

DE 102007028301 A1 12/2007
JP 2016024971 A 2/2016
(Continued)

OTHER PUBLICATIONS

Written Opinion of the International Searching Authority & International Search Report, Application No. PCT/AT2018/060208, Completed: Oct. 23, 2018; dated Nov. 6, 2018, 5 Pages.

*Primary Examiner* — Anne M Hines
(74) *Attorney, Agent, or Firm* — Whitmyer IP Group LLC

(57) ABSTRACT

The present teaching relates to an illumination module for emitting light directed in parallel in a main emission direction, having a reflector with a focus lying on the front side thereof. At least one LED light source is arranged substantially at the focus of the reflector for radiating light into the reflector. A heatsink is arranged on the rear side of the reflector. The LED light source is oriented counter to the main emission direction. The reflector is configured to direct the light radiated into the reflector by the at least one LED light source in parallel and emit the light in the direction of the main emission direction. The at least one LED light source is held by means of at least one connecting web extending from the heatsink to the LED light source.

18 Claims, 11 Drawing Sheets

(51) Int. Cl.

| | |
|---|---|
| ***F21V 29/76*** | (2015.01) |
| ***F21V 9/30*** | (2018.01) |
| ***F21S 2/00*** | (2016.01) |
| ***F21S 6/00*** | (2006.01) |
| ***F21V 3/02*** | (2006.01) |
| ***F21V 7/00*** | (2006.01) |
| ***F21V 7/06*** | (2006.01) |
| ***F21V 14/04*** | (2006.01) |
| ***F21V 19/00*** | (2006.01) |
| *F21Y 115/10* | (2016.01) |
| *F21W 131/406* | (2006.01) |

(52) U.S. Cl.
CPC ..... *F21V 7/0008* (2013.01); *F21V 7/06* (2013.01); *F21V 9/30* (2018.02); *F21V 14/04* (2013.01); *F21V 19/003* (2013.01); *F21V 29/713* (2015.01); *F21V 29/767* (2015.01); *F21W 2131/406* (2013.01); *F21Y 2115/10* (2016.08)

(58) Field of Classification Search
CPC ..... F21V 7/06; F21V 14/04; F21V 19/003; F21S 2/005; F21S 6/007; F21Y 2115/10; F21W 2131/406
See application file for complete search history.

(56) References Cited

U.S. PATENT DOCUMENTS

| | | | | |
|---|---|---|---|---|
| 2013/0242557 | A1* | 9/2013 | Zeng | F21V 29/773 362/249.02 |
| 2015/0204520 | A1* | 7/2015 | Pearson | F21V 7/0008 362/294 |

FOREIGN PATENT DOCUMENTS

| | | | |
|---|---|---|---|
| KR | 20130070284 | A | 6/2013 |
| WO | 2012141036 | A1 | 10/2012 |
| WO | 2013123570 | A1 | 8/2013 |

* cited by examiner

ILLUMINATION MODULE FOR EMITTING LIGHT DIRECTED IN PARALLEL

TECHNICAL FIELD

The present teaching relates to an illumination module for emitting (preferably exclusively) light directed in parallel in a main emission direction, the illumination module comprising a reflector with a focus lying on the front side thereof, at least one LED light source arranged substantially at the focus of the reflector for radiating light into the reflector, and a heat sink arranged on the rear side of the reflector. The present teaching also relates to a lighting device, in particular a filming spotlight, for emitting light directed in parallel, the lighting device comprising a number of illumination modules according to the present teaching.

BACKGROUND

Different illumination modules for emitting light direct in parallel are known from the prior art. Conventional stage lights for emitting light direct in parallel for example comprise gas discharge lamps, which are arranged in the region of a focus of a reflector. Due, however, to the spatial extent of gas discharge lamps, it is not possible to arrange such a light source exclusively in the focus of the reflector. Conventional spotlights of this kind have a divergence which is not insignificant, as well as considerable spatial dimensions, which prevent the production of a compact, flat lamp.

Alternatively, illumination modules comprising LED light sources have already been provided. The LED light source has small spatial dimensions in comparison to a gas discharge lamp. The light emitting surface of an LED light source is relatively small and can be arranged easily within a reflector. Light is emitted by an LED light source generally inhomogeneously, i.e. the light is emitted in the form of a typically non-linear, diverging light distribution, and the light intensity varies depending on the angle of the mission.

The illumination modules known from the prior art have a high spatial requirement and/or are unsuitable for providing a parallel light emission which is as accurate as possible.

SUMMARY

One object of the present teaching is therefore to overcome the aforementioned disadvantages of the prior art. This object is achieved by an illumination module of the kind described in the introduction, in which, in accordance with the present teaching, the LED light source is oriented counter to the main emission direction, wherein the reflector is configured to direct the light radiated into the reflector by the at least one LED light source in parallel and emit said light in the direction of the main emission direction, wherein the at least one LED light source is held by means of at least one connecting web extending from the heat sink to the LED light source, the at least one connecting web being designed to conduct heat from the at least one LED light source into the heat sink, and the at least one connecting web, which preferably consists at least partially of metal, thermally contacts the at least one LED light source and the heat sink, wherein the at least one connecting web additionally comprises means for electrically contacting the at least one LED light source.

Due to the orientation according to the present teaching of the LED light source counter to the main emission direction, it is possible to balance the emission characteristic of an LED light source by the reflector to such an extent that the light emitted by the illumination module can be emitted exclusively as light directed in parallel. The expression "arranged substantially at the focus" in this case takes into account the fact that the at least one LED light source—due to the spatial extent of its light emitting surface—can never lie completely exclusively at the focus. However, for the emission of light directed in parallel, it is sought to arrange the LED light source as precisely as possible at this focus or to arrange a center of gravity of the light emitting surface at this focus.

Due to the illumination module according to the present teaching, a compact lighting device for emitting light directed in parallel is created, which lighting device can be dimensioned in principle with a surface area of any size by stringing together further illumination modules.

In particular, it may be used in the following technical fields or products or for the following purposes: film and photography, emulation of sunlight without the flaws of other approaches (stage lights, Arri M-series lights, PAR spotlights, incubator lights), light tubes (photography of cars and surfaces that are shiny over a large area, soft light with soft shadows). In particular, the illumination module according to the present teaching is particularly suitable for use by lighting technicians, chief lighting technicians, photographers, production companies, renters of lighting and camera equipment, sellers of lighting equipment, and in conjunction with event equipment.

Due to the illumination module according to the present teaching, extremely narrow light beams can be provided over large distances. Single-pixel solutions and RGB special effects are also conceivable in concert halls, in theatres or for applications in the field of building lighting. Artificial suns (=light spots with high illumination powers as compared to the ambient environment in buildings, intended to imitate solar radiation), floodlight systems (at sports venues, airports, large plants) or narrow-beam emitters (façade lighting, lighting of buildings and bridges, lighting over large distances) or searchlights can thus also be produced.

In order to enable a particularly good, heat conductive, stable connection between the LED light source and the heat sink, it may be provided that the at least one connecting web is formed as a metal pipe with cooling liquid received inside the metal pipe.

In particular, it may be provided that the illumination module has at least two connecting webs, preferably exactly three connecting webs, which extend through the reflector towards the at least one LED light source, wherein the angle which adjacent connecting webs enclose with one another within a virtual plane normal to the main emission direction is the same for all connecting webs. A particularly stable arrangement can thus be achieved, by means of which the electrical and thermal contacting of the LED light source may be facilitated. If two connecting webs are provided, these thus enclose an angle of 180° with one another; if three connecting website are provided, these are arranged at an angle of 120° to one another, etc.

By forming at least one metal electrical line along the connecting web as part of the connecting web, it may advantageously be provided that the means for electrically contacting the at least one LED light source is formed by the connecting web itself (the connecting web may thus be electrically conductive).

Alternatively, it may be provided that the means for electrically contacting the at least one LED light source is formed by at least one separate electrical line guided along the web.

In order to create a particularly compact and robust illumination module, it may be provided that the heat sink, the reflector, the at least one connecting web, and the at least one LED light source form a structural unit.

In addition, it may be provided that the front side of the reflector is covered by a transparent protective glass, wherein the at least one LED light source is enclosed between the reflector and protective glass. In particular, it may be provided that the reflector is delimited by side faces (which may be formed as part of the reflector and/or as part of the housing) oriented parallel to the main emission direction and the protective glass extends as far as the side faces, wherein the side faces additionally define the geometric dimensions of the illumination module normal to the main emission direction. Due to the extent of the transparent protective glass as far as the edge of the reflector and the avoidance of elements protruding beyond the edge, the illumination modules can be strung together almost seamlessly, so that a homogeneous light transition between directly adjacently arranged illumination modules is possible. The reflector in this case extends continuously as far as all side faces, whereby a uniform emission that is as homogeneous as possible is ensured.

It may preferably be provided that the protective glass and the reflector are sealed with respect to one another, and the at least one connecting web and the reflector are sealed with respect to one another. The illumination module itself is thus sealed and thus protected against the infiltration of dust or water.

In order to arrange the LED light source manually exactly at the focus in order to optimize the focusing—or to move it out of this position for the purpose of a slight defocusing—the at least one LED light source may be rigidly coupled to the heat sink by means of the at least one connecting web, wherein the reflector is displaceable in relation to the at least one LED light source (or vice versa) along a portion of the at least one connecting web, which portion is oriented in the main emission direction. For this purpose, and as a particularly expedient embodiment, it may be provided that, for displacement of the reflector in relation to the at least one LED light source, the reflector acts on the heat sink by means of an adjustment screw, by means of which the reflector is displaceable in the main emission direction. In order to change the light characteristic, the LED may be moved out of the ideal focus. This may be advantageous for special applications when more or less light is to be directed to a specific surface depending on the distance of the target. In this regard, other kinds of focusing or defocusing also conceivable: 1.) Focusing in order to adjust the modules amongst themselves, each module is therefore adjusted individually. 2.) Focusing in which all modules may be coupled. This variant may be implemented for example with the aid of a servomotor.

In order to limit any divergence to a minimum level, it may be provided that the ratio of maximum LED light emitting surface diagonal to maximum reflector diagonal is at most 1:20, preferably at most 1:40. A particularly reliable bundling of the light beams can thus be achieved. In the case of circle shapes, the maximum diagonal corresponds to the circle diameter.

Particularly powerful parallel emitters can thus be provided by means of the illumination module according to the present teaching. To this end, it may be provided that the reflector surface and luminous flux of the LED are selected in such a way that the illumination in the vicinity of the front side of the reflector in a plane normal to the main emission direction is between 50,000 and 150,000 lx. The term "vicinity" is understood here to mean a distance in the order of one to five times the diameter of the reflector.

In order to optimize the light distribution emitted by the LED light source, it may be provided that a primary optics, in particular a lens and/or a mixing rod or a reflector, is attached to the at least one LED light source, by means of which primary optics the light distribution emitted by the at least one LED light source is changed. In this way, a further possibility 4 optimization is created and for example permits flatter reflector designs or a reduction of inhomogeneities within the light distribution emitted by the illumination module.

In order to attain the most homogeneous possible transition between the illumination modules in the case that a plurality of illumination modules are used, it may be provided that the geometric shape of the illumination module is selected in such a way that an arbitrarily extendable form-fitting, area-filling arrangement of illumination modules within a plane is attainable due to a planar arrangement side-by-side and/or an arrangement one above the other of individual illumination modules having the same geometric shape. The expression "arrangement one above the other" is understood to mean an arrangement in which the illumination modules are arranged above or below one another within a plane normal to the main emission direction.

Furthermore, it may be provided that a plurality of LED light sources is provided which are configured to form a common remote-phosphor light source by arrangement of a common remote-phosphor element downstream of the LED light sources, which remote-phosphor element is designed for conversion of the light emitted by the LED light sources, wherein the LED light sources are designed to emit light into the remote-phosphor element. The expression "a plurality" is understood to mean a number greater than or equal to three. A multiplicity of LEDs may preferably be arranged in a matrix. For example, these may be LEDs that emit blue light, which for example may be converted into white light by the remote-phosphor element (the expression "remote-phosphor" is used as a synonym for a converter in the general sense). As a result of this arrangement, it is possible to achieve a particularly high power density of the light emission and yet a satisfactory cooling of the light source, since the heat sources constituted by the "LEDs" and "converter" are distanced from one another so that the heat dissipation is improved and temperature peaks may be reduced.

For example, in order to be able to change the emission behavior of the light source, it may be provided that the LED light sources are arranged on a first carrier, wherein the remote-phosphor element is arranged on a second carrier, and wherein holding means are provided, which are designed for releasable connection of the first and second carrier. The LED light sources may thus be connected to different remote-phosphor elements, which for example are designed for emission with different light distributions and color temperatures.

It may additionally be provided that the primary optics 9 is fixedly connected to the second carrier 14. The primary optics 9 may thus be easily exchanged, inclusive of the associated remote-phosphor elements.

The present teaching also relates to a lighting device, in particular a filming spotlight, for emitting light directed in parallel, the lighting device comprising a number of illumination modules according to the present teaching, wherein adjacent illumination modules border one another form-fittingly.

The expression "a number of" is understood within the scope of this disclosure—unless stated otherwise—to mean a number which for example may be one, two, three, four or more, in particular six, eight, ten, fifteen, twenty or more. A person skilled in the art is able to choose the number of illumination modules in accordance with the desired light emitting surface of the lighting device.

It may additionally be provided that the illumination modules are arranged in the form of a matrix, wherein the matrix has at least n rows and at least m columns, wherein n and m are natural numbers and are at least 1, 2, 3, 4, 5, or at least 10.

In order to achieve a rectified emission by means of all illumination modules, it may be provided that all illumination modules are arranged two-dimensionally within a plane, wherein the main emission direction of the individual illumination modules is the same.

Before an exemplary embodiment of the present teaching is discussed in greater detail hereinafter, some general information regarding the present teaching will first be provided.

Due to the illumination module or the lighting device according to the present teaching, a property that is very important for an application in the film industry is achieved, specifically a relatively large and homogeneous beam cross-section, already just after the beam has left the lighting system.

With a ratio of the diameter of the LED (LES [=Light Emitting Surface]) to the diameter of the module (circumference) of from 1 to 40 (actual dimensions preferably 3 mm to 120 mm), very narrow-beam systems can be constructed, which have almost sun-like light properties.

White LEDs with a warm white, neutral white or cold white color are preferably used, wherein precisely one LED may be provided per reflector. Alternatively, an array of small individual LEDs may be provided. A variant with a multi-chip LED may also be provided. The LEDs May have different light colors, for example warm white and cold white and/or red, green or blue. Since the LEDs may be individually actuated in targeted fashion, both the light intensity and the light color may be varied in targeted fashion.

On the one hand, the modularity of the illumination modules is of particular advantage. On the other hand, it is also conceivable to use the illumination modules individually. For example, an individual high-power module comprising an LED (LES=19 mm) with 500 W and a reflector with a diameter of from 500 mm to 700 mm could be provided. The connecting webs may be, for example in the case of the small modules, conventional "heat pipes" formed from liquid-filled metal pipes. In principle, any other material that is a good thermal conductor is also conceivable. In the case of more powerful modules, a liquid cooling could also be envisaged.

If the power supply is provided directly via the connecting webs as conductors, two connecting website preferably provided. If a color temperature change should also be provided, a feed via three connecting webs is advantageous (for example 1× common cathode and 2× one anode).

The reflector preferably has a parabolic contour and for example consists of an injection molded material, which is vapor-coated by means of a reflective layer, or is made of metal (for example formed from sheet aluminum).

A primary optics could be formed for example in the form of a primary lens. By changing the light distribution of the LED (that is to say how much light impinges where and how strongly on the reflector), the light distribution of the module is also influenced. An optimal superposition of the individual modules may thus be achieved.

BRIEF DESCRIPTION OF THE DRAWINGS

The present teaching will be explained in greater detail hereinafter with reference to exemplary and non-limiting embodiments which are shown in the drawings. In the drawings.

DETAILED DESCRIPTION

Hereinafter, like reference signs denote like features unless stated otherwise.

Figure 1A:
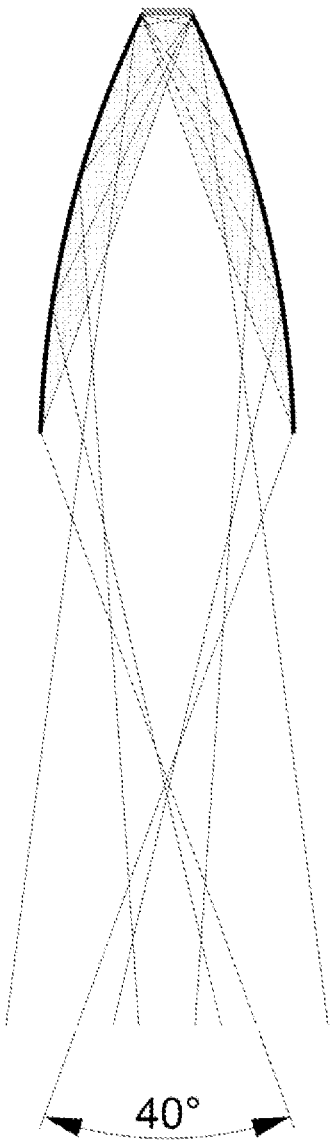
FIGS. 1*a* and 1*b* each show a schematic illustration of the emission characteristic of a reflector arrangement according to the prior art.
Figure 1B:
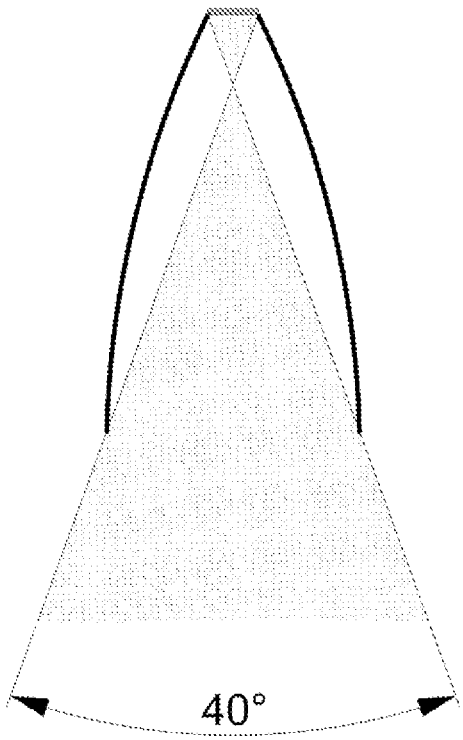

FIGS. 1*a* and 1*b* each show a schematic illustration of the emission characteristic of a reflector arrangement according to the prior art, in which a light source, for example in the form of an LED, is arranged in the center of the reflector and emits light in a main emission direction. It can be seen that a component of the light of the light source is reflected on the one hand by the reflector and is thus oriented, but on the other hand a remaining component leaves the reflector unreflected at an emission angle of up to 40°. Such arrangements therefore are not very suitable for the imaging exclusively of light directed in parallel.

Figure 2:
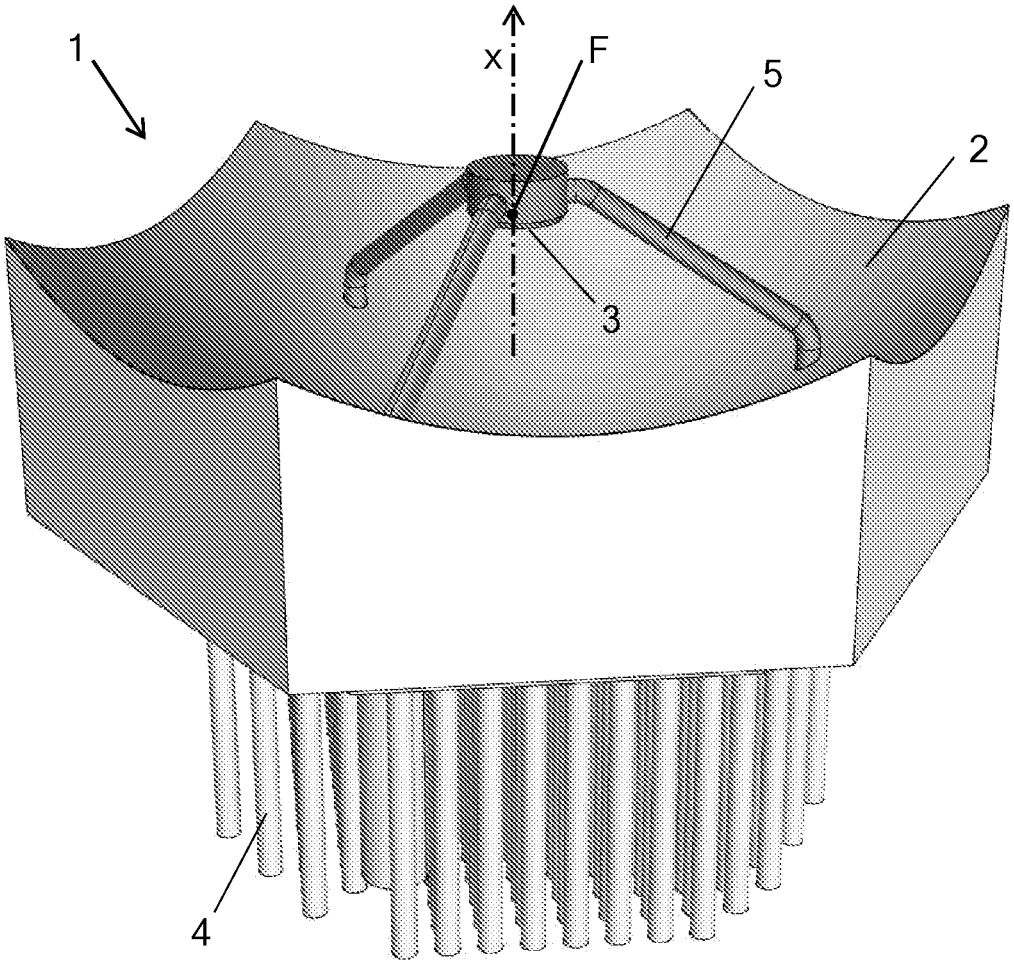
FIG. 2 shows a perspective illustration of an embodiment of an illumination module according to the present teaching.

FIG. 2 shows a perspective illustration of an embodiment of an illumination module 1 according to the present teaching. The illumination module 1 is designed for the emission of light directed in parallel in a main emission direction x, and for this purpose comprises a reflector 2 with a focus F lying on the front side thereof, at least one LED light source 3 arranged at the focus F of the reflector 4 radiating light into the reflector 2, and a heat sink 4 arranged on the rear side of the reflector 2.

The LED light source is oriented counter to the main emission direction x (which in turn is oriented parallel to the optical axis of the reflector), wherein the reflector 2 is designed to direct light in parallel and to emit light in the direction of the main emission direction x. The at least one LED light source 3 is held by means of at least one connecting web 5 extending from the heat sink 4 to the LED light source 3—in the present embodiment three connecting webs 5 are provided. The at least one connecting web 5 is designed to conduct heat from the at least one LED light source 3 to the heat sink 4 and preferably consists at least partially of metal. Each connecting web 5 is thermally connected to the at least one LED light source and the heat sink, wherein the connecting web 5 additionally comprises means for electrically contacting the at least one LED light source 3. These means may be formed by separate electrical lines, for example insulated electrical Litz wires guided along the web 5, or lines integrated in the web 5 (to this end, the web 5 itself may be electrically conductive).

Figure 3:
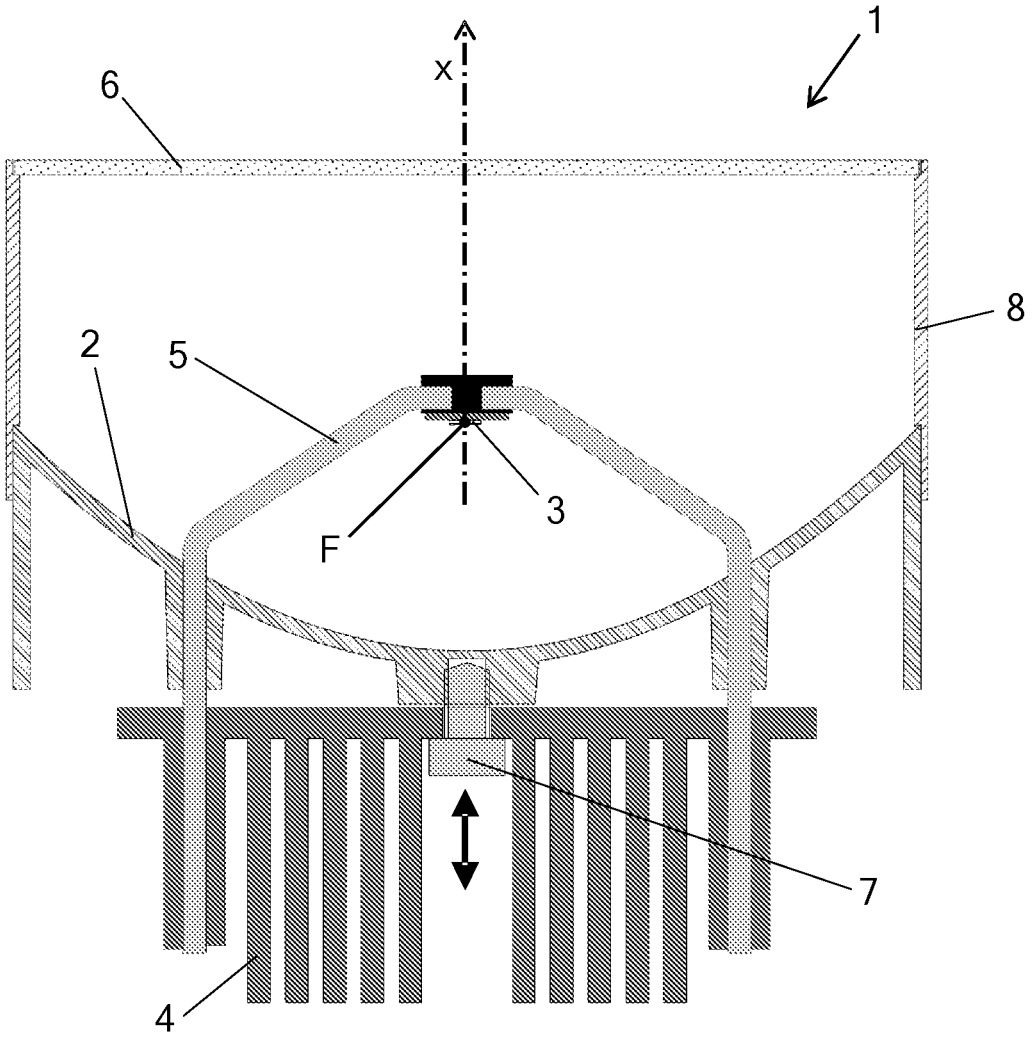
FIG. 3 shows a schematic sectional illustration of the illumination module according to FIG. 2.

FIG. 3 shows a schematic sectional illustration of the illumination module 1 according to FIG. 2. It can be seen that the front side of the reflector 2 is covered by transparent protective glass 6, wherein the at least one LED light source 3 is enclosed between the reflector 2 and the protective glass 6. The at least one LED light source 3 is connected rigidly to the heat sink 4 by means of the at least one connecting web 5, wherein the reflector 2 is displaceable in relation to the at least one LED light source 3 along a portion of the connecting webs 5, which portion is oriented in the main emission direction x. For displacement of the reflector 2 in relation to the at least one LED light source 3, the reflector 2 acts on the heat sink 4 by means of an adjustment screw 7, wherein the reflector 2 is displaceable in relation to the light-emitting diode 3 in the main emission direction x by rotation of the adjustment screw 7.

Figure 4:
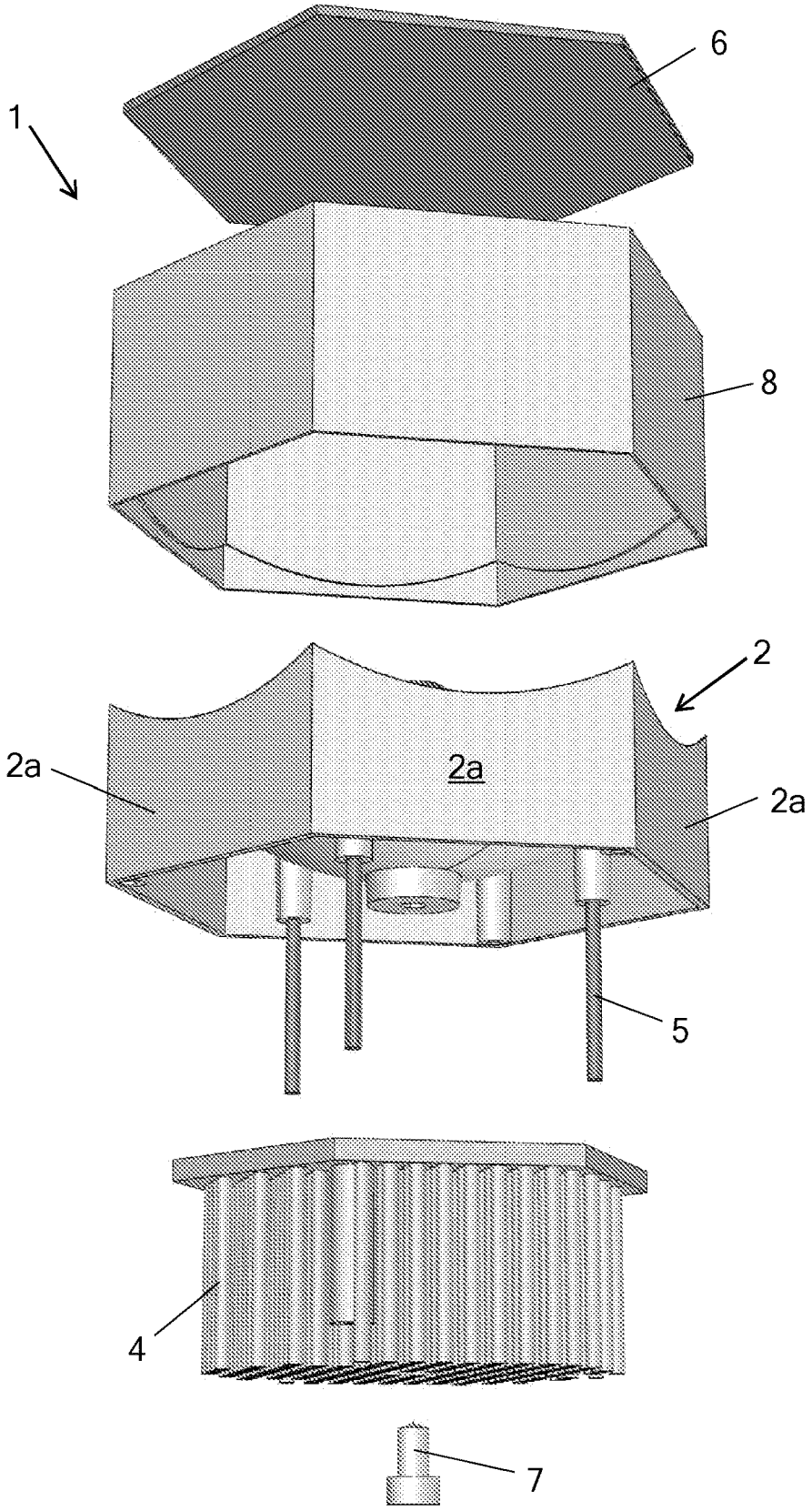
FIG. 4 shows an exploded illustration of the illumination module according to FIGS. 2 to 3.

FIG. 4 shows an exploded illustration of the illumination module 1 according to FIGS. 2 to 3. It can be seen that the protective glass 6 engages with a housing 8, which surrounds the side walls 2*a* of the reflector 2 flushly and extends as far as the protective glass 6.

Figure 5:
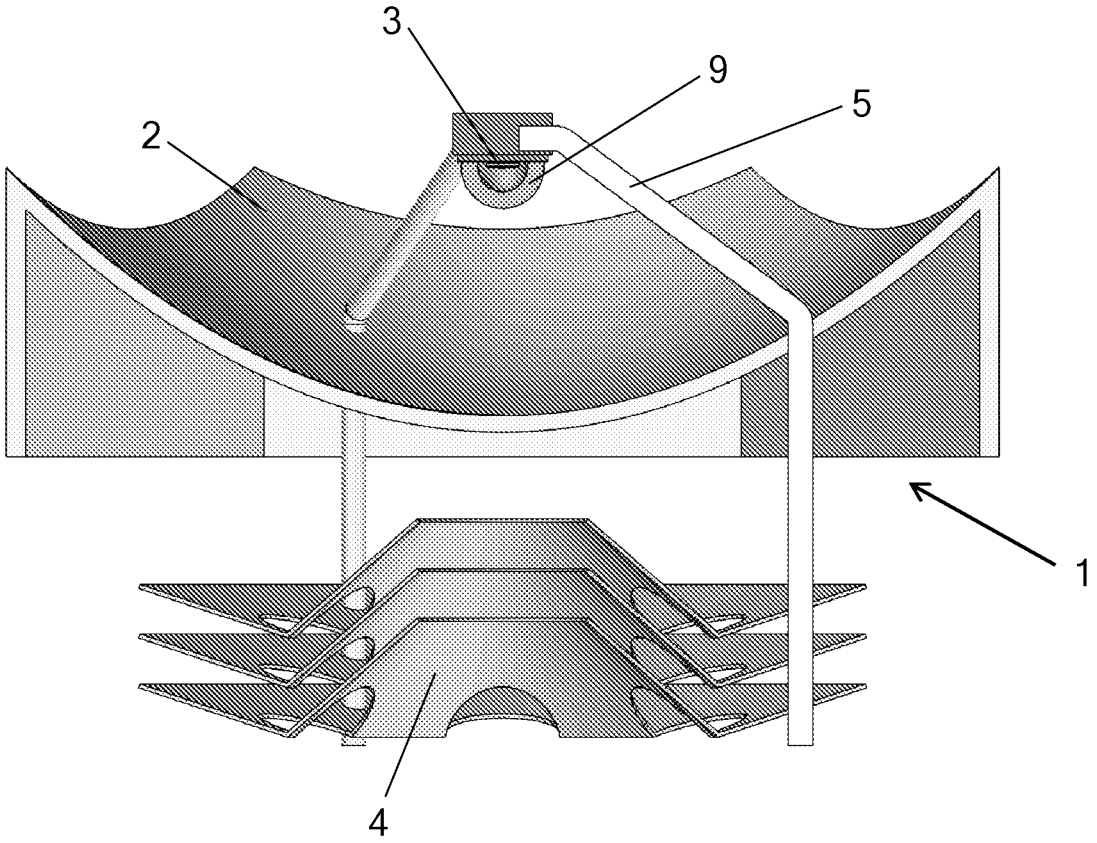
FIG. 5 shows a sectional illustration of a further embodiment of an illumination module according to the present teaching.

FIG. 5 shows a sectional illustration of a further embodiment of an illumination module 1 according to the present teaching. A primary optics 9, in the present case in the form of a primary lens, is attached to the at least one LED light source 3 and is used to change the light distribution emitted through the at least one LED light source.

Figure 6A:
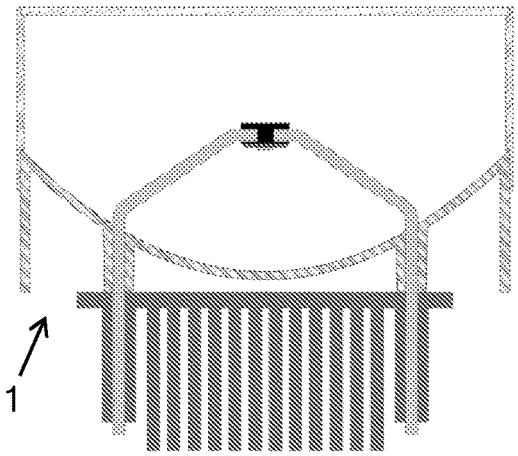
FIGS. 6*a* to 6*f* show schematic sectional illustrations of further embodiments of an illumination module according to the present teaching.
Figure 6B:
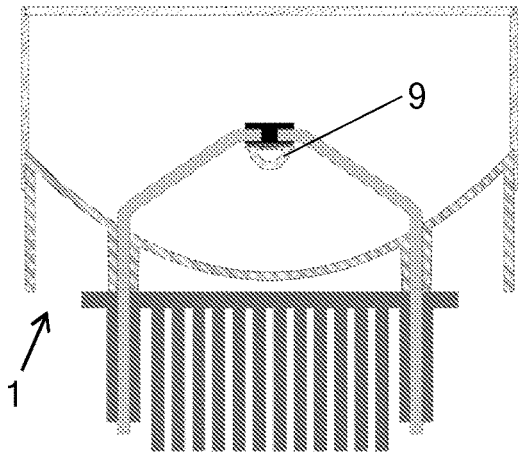
Figure 6C:
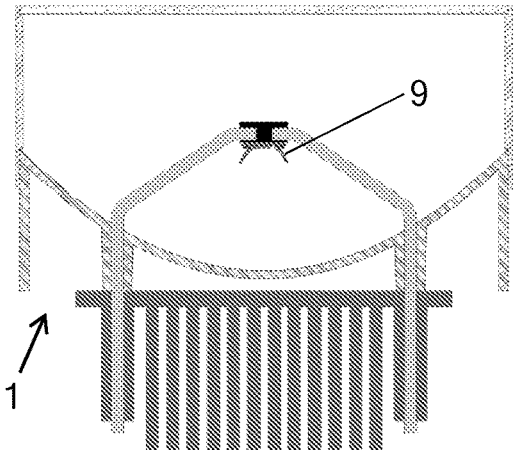
Figure 6D:
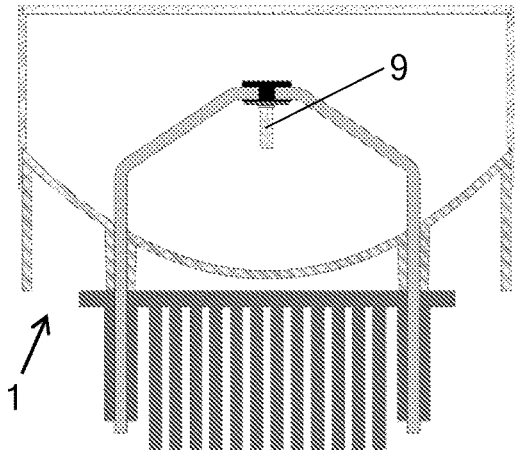
Figure 6E:
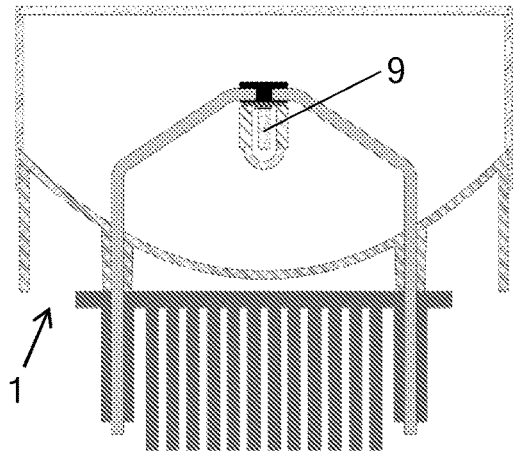
Figure 6F:
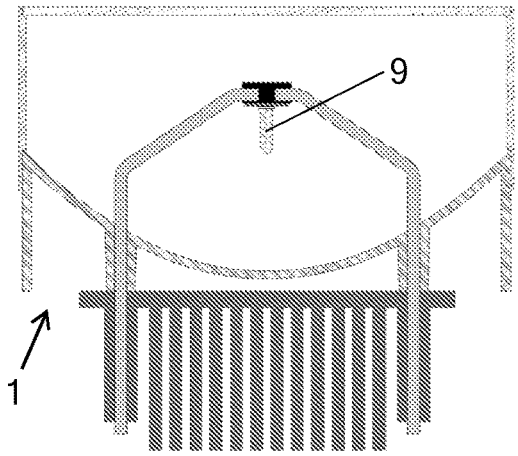

FIGS. 6*a* to 6*f* shows schematic sectional illustrations of further embodiments of an illumination module 1 according to the present teaching, wherein the variant according to FIG. 6*a* does not have a primary optics, in the variant according to FIG. 6*b* the primary optics 9 is formed as a lens, in FIG. 6*c* as a reflector, in FIG. 6*d* as a mixing rod (for mixing different light colors, which for example are radiated into the mixing rod through different light emitting surfaces of a corresponding light source or corresponding light sources), in FIG. 6*e* is a combination of mixing rod and primary lens, and in FIG. 6*f* as a mixing rod with integrated emission optics on the light emitting surface of the light rod.

Figure 7A:
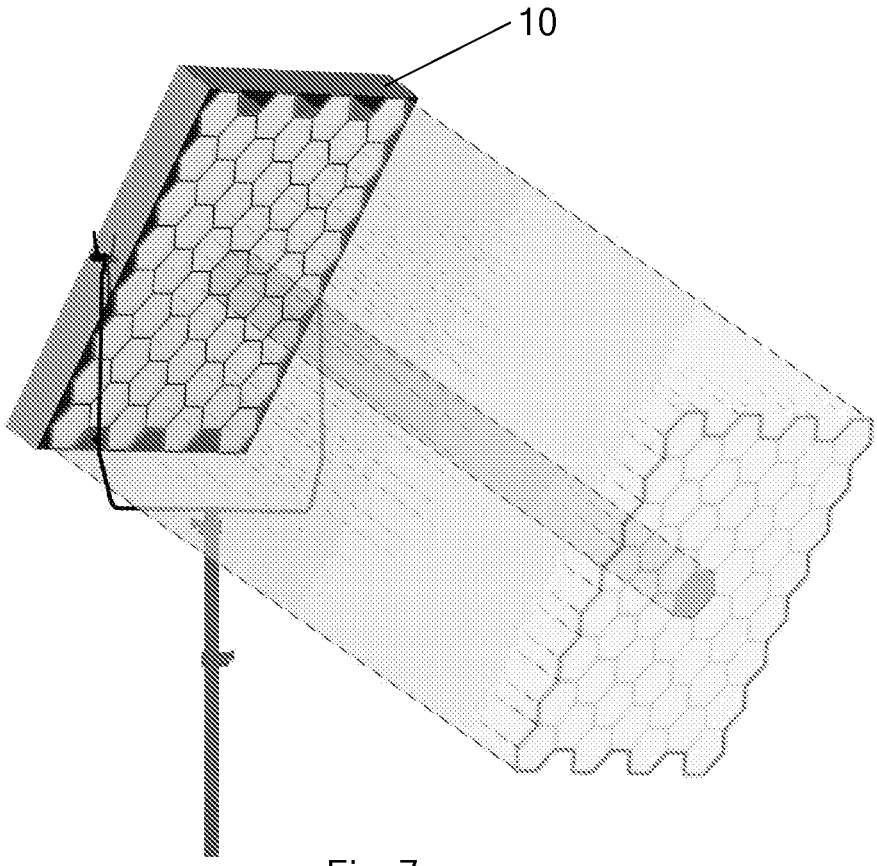
FIG. 7*a* shows a lighting device according to the present teaching comprising a number of illumination modules according to the present teaching.
Figure 7B:
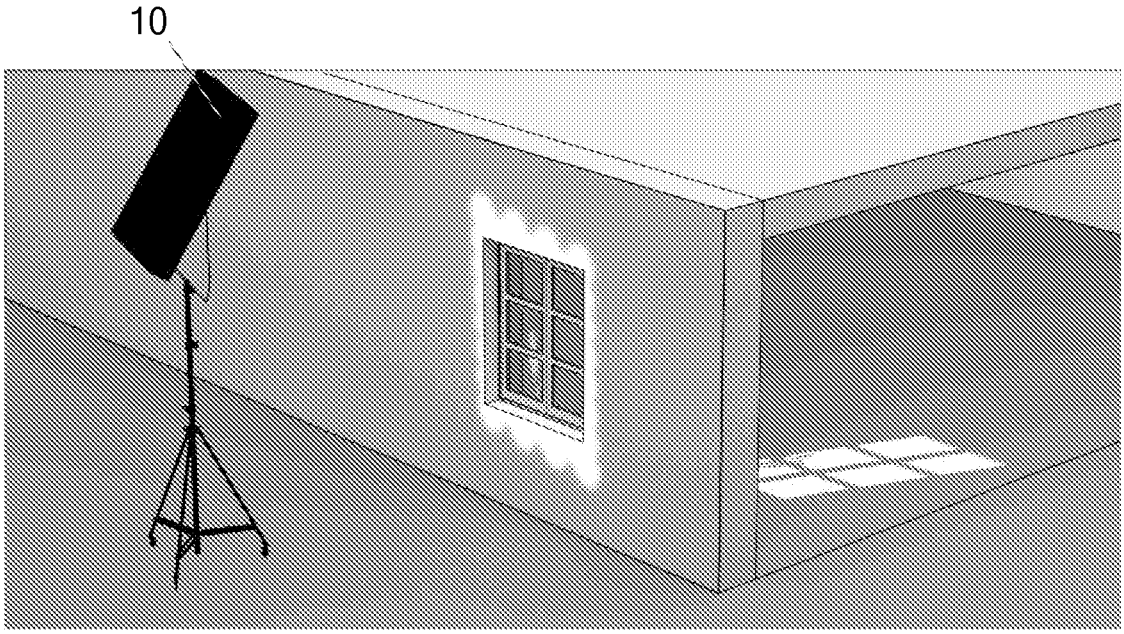
FIG. 7*b* shows a shadow image produced by a lighting device according to FIG. 7*a;*

FIG. 7*a* shows a lighting device 10 according to the present teaching comprising a number of illumination modules 1 according to the present teaching, which are arranged form-fittingly next to one another and one above the other within a plane. FIG. 7*b* shows a shadow image produced by a lighting device 10 according to FIG. 7*a*. It can be seen that the shadow of the window shown therein is sharply outlined on account of the parallel light emission and corresponds to a normal projection of the window onto the shadow plane.

Figure 9A:
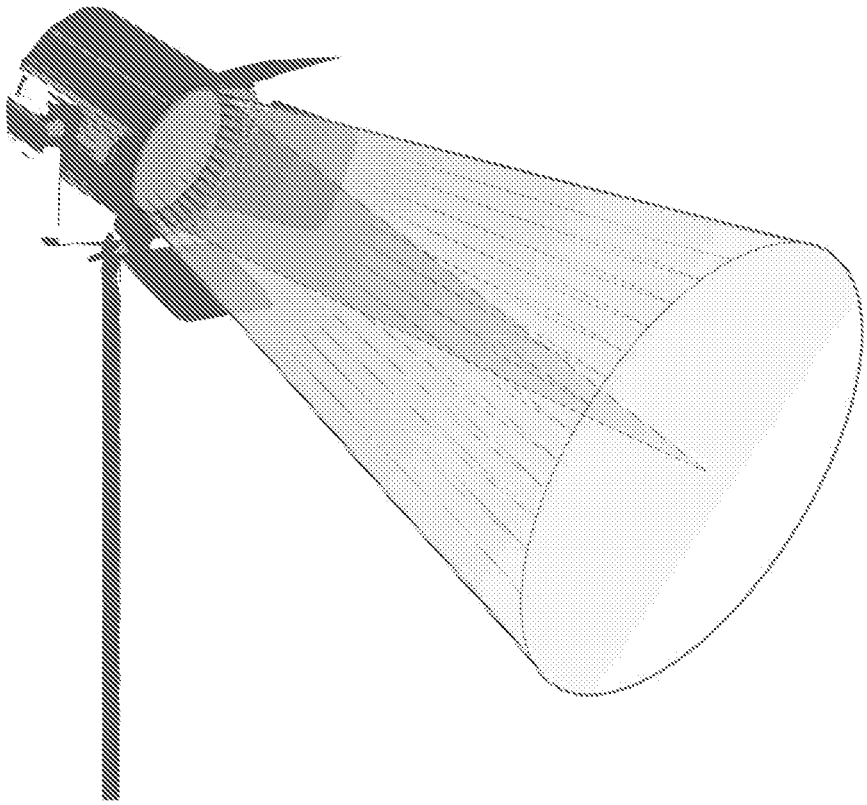
FIG. 9*a* shows a lighting device according to the prior art.
Figure 9B:
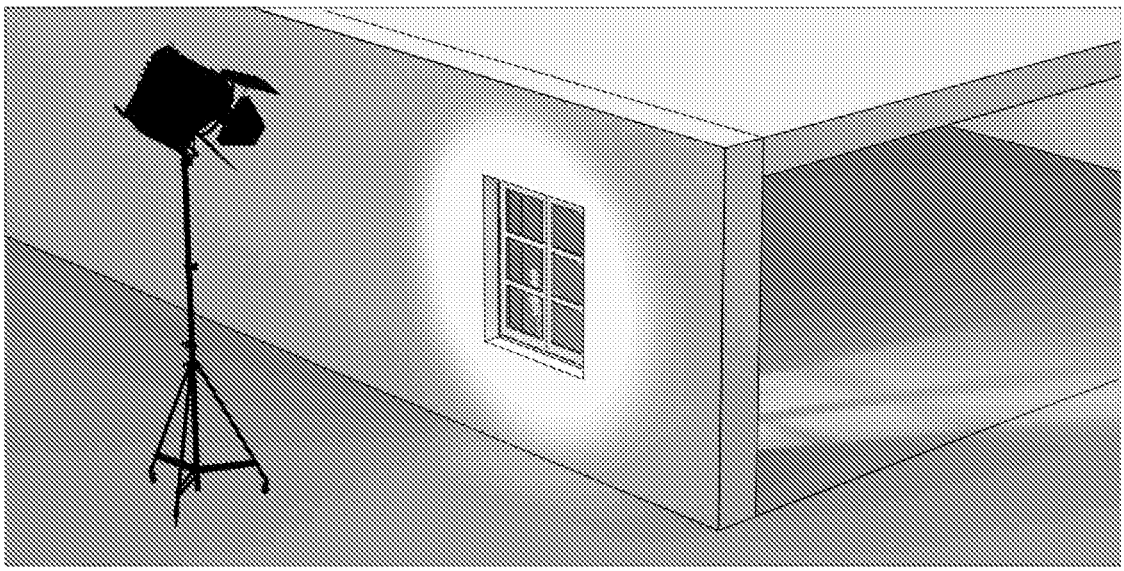
FIG. 9*b* shows a shadow image produced by the lighting device according to FIG. 9*a;*
Figure 10A:
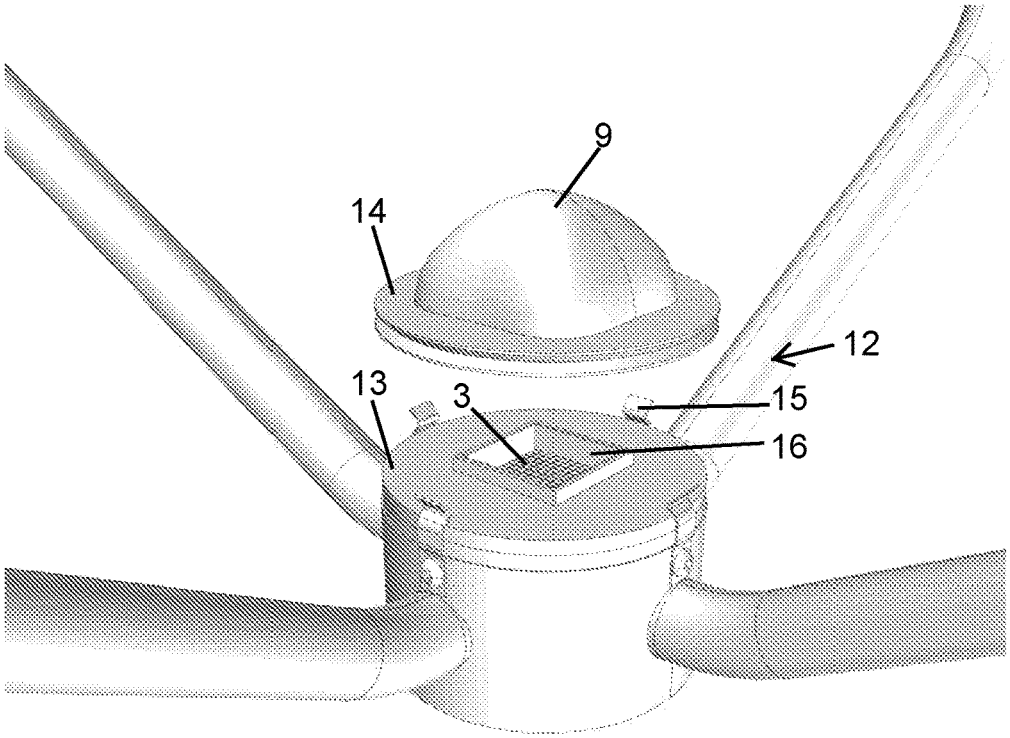
FIGS. 10*a* and 10*b* show a further embodiment of a detail of an illumination module according to the present teaching in which the light source is formed as a remote-phosphor light source.
Figure 10B:
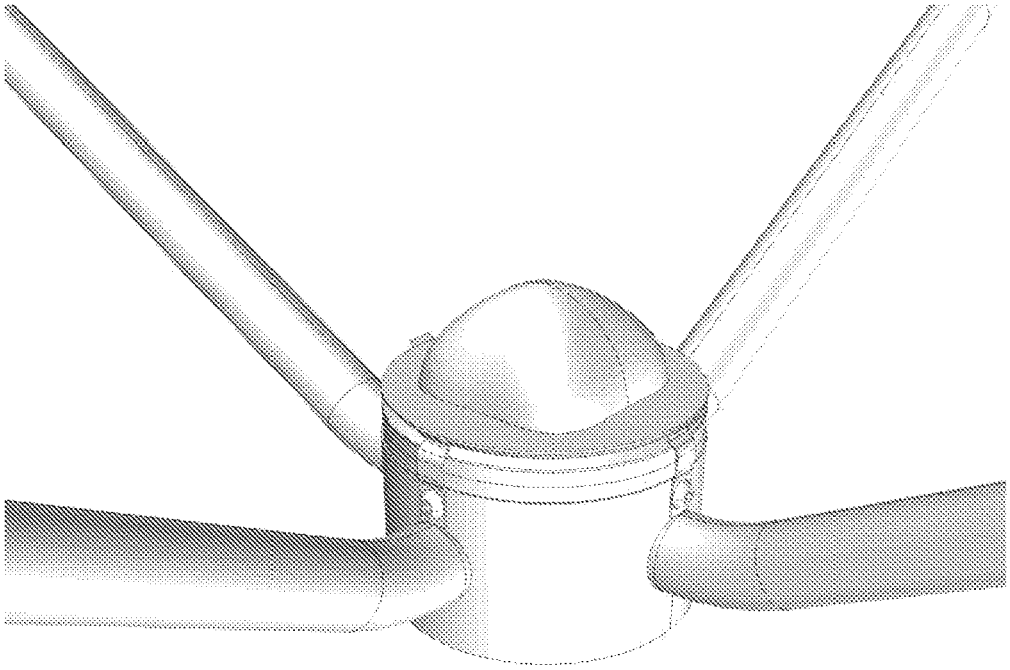
Figure 11A:
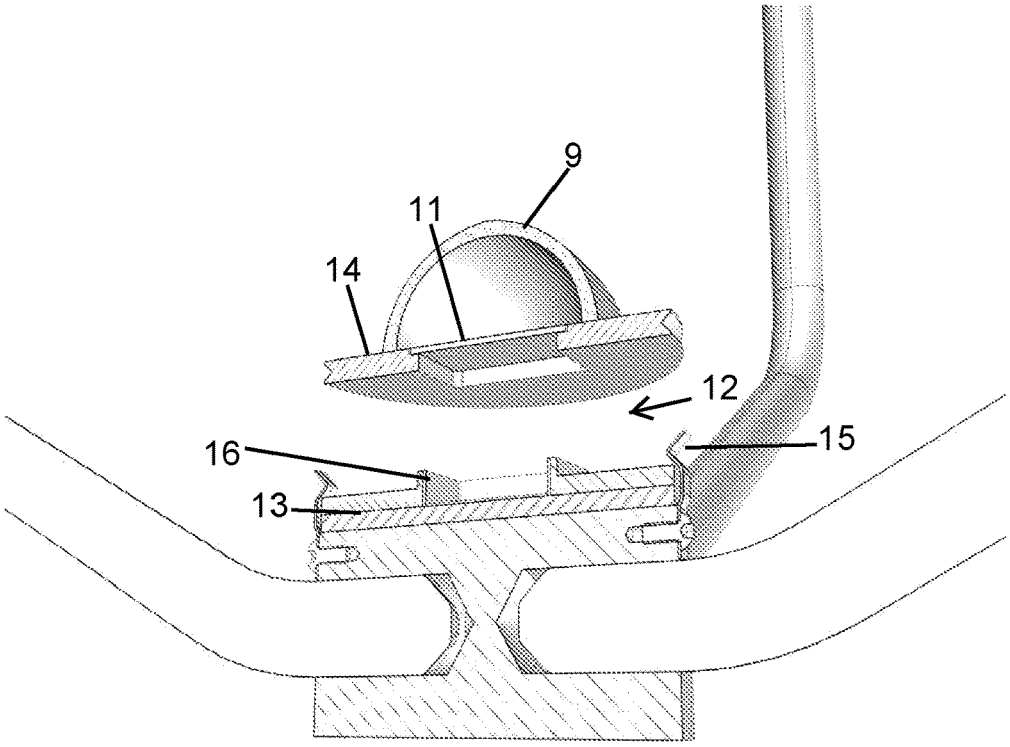
FIGS. 11*a* and 11*b* show sectional illustrations of the illumination module according to FIGS. 10*a* and 10*b*.
Figure 11B:
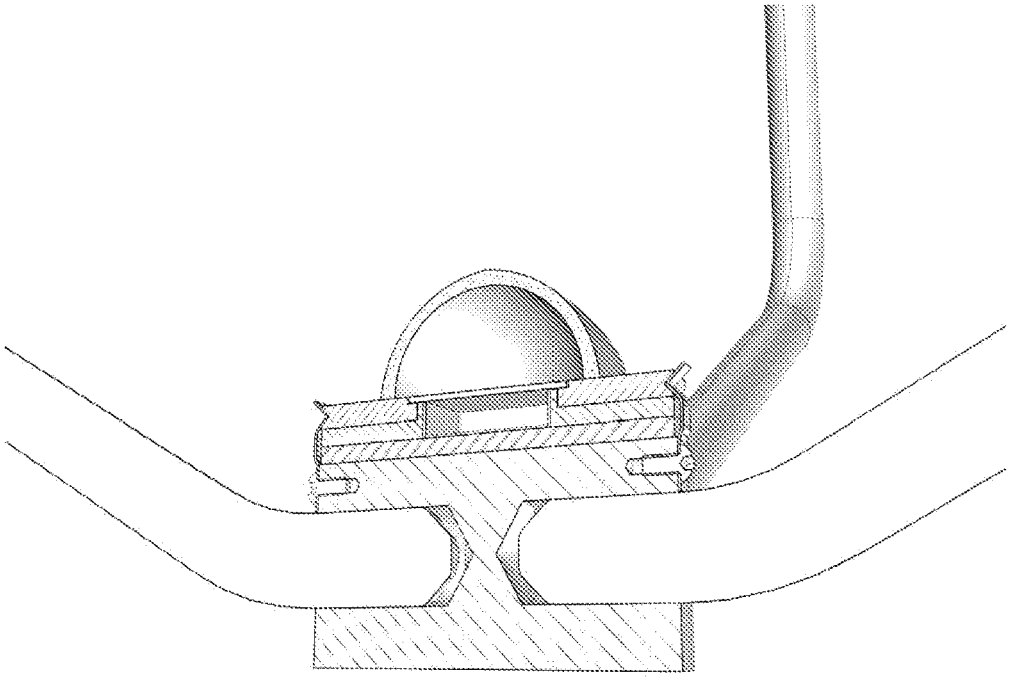

FIGS. 9*a* and 9*b*, by contrast, show a lighting device according to the prior art and a shadow image produced there with. A blurred imaging of the shadow and a widening of the shadow elements are clearly visible.

Figure 8:
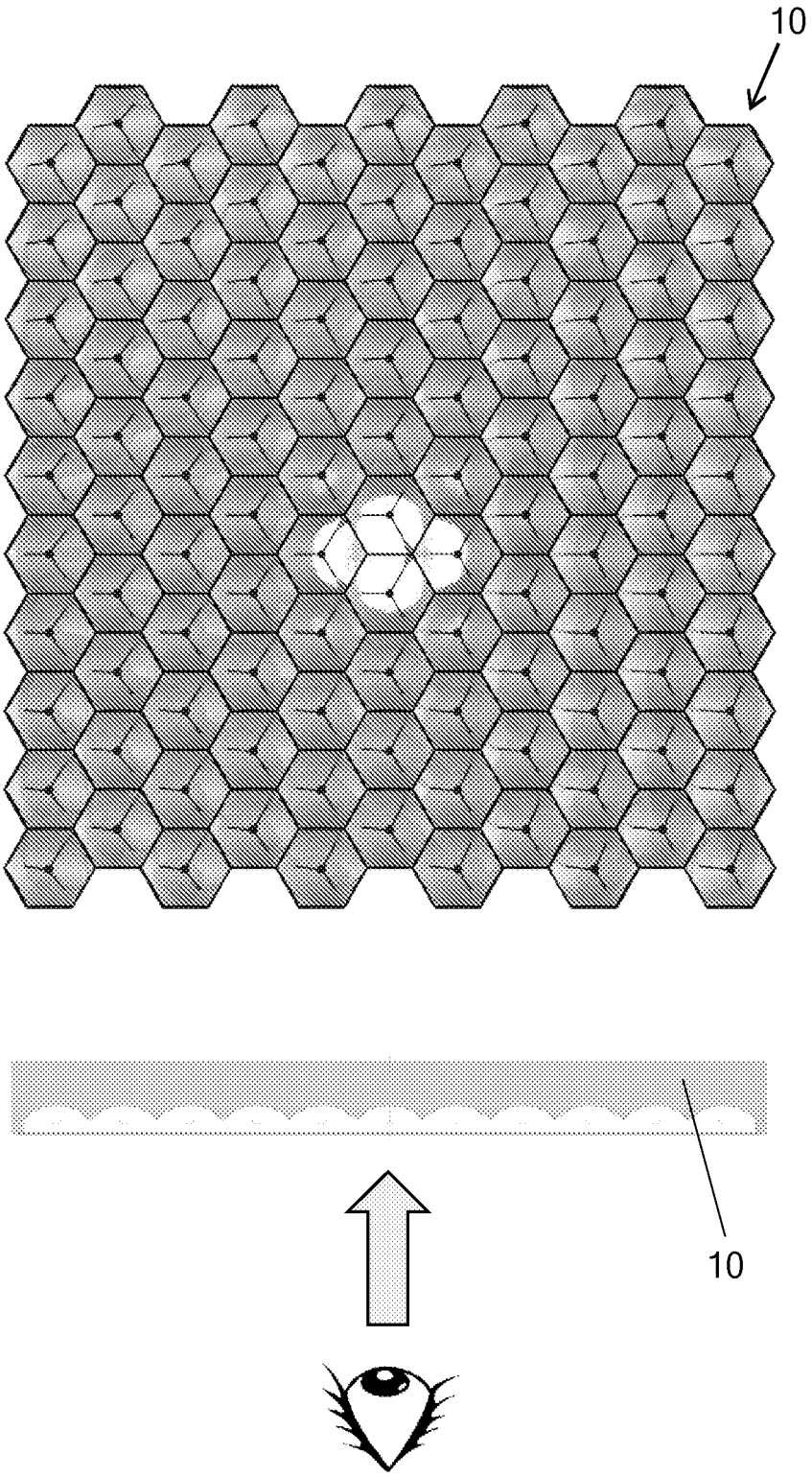
FIG. 8 shows a schematic image of the optical impression given to a viewer of a lighting device in operation depending on the viewer's position.

FIG. 8 shows a schematic view of the optical impression given to a viewer of a lighting device 10 in operation depending on the viewer's position. The emission of the light emitted by the lighting device 10 is directed in parallel to a high level so that only those areas that lie directly in front of the eye in the main emission direction x are perceived to be light-emitting by a viewer.

FIGS. 10*a* to 11*b* show a further embodiment of a detail of an illumination module 1 according to the present teaching. In order to provide an improved overview, reference signs have been included only in FIGS. 10*a* and 11*a*. The illumination module 1 comprises a plurality of LED light sources 3, which are configured to form a common remote-phosphor light source 12 by arrangement of a common remote-phosphor element 11 downstream of the LED light sources 3 (see FIG. 11*a*), which remote-phosphor element is designed for conversion of the light emitted by the LED light sources 3, wherein the LED light sources 3 are designed to emit light into the remote-phosphor element 11. The LED light sources 3 and the downstream remote-phosphor element 11 are in this case separated spatially from one another or distanced from one another.

The LED light sources 3 are arranged on a first carrier 13. The remote-phosphor element 11 is arranged on a second carrier 14, wherein holding means 15 are provided, which are designed for releasably connection of the first carrier 13 and second carrier 14. As can be clearly seen in FIGS. 11*a* and 11*b*, the second carrier 14 has a groove at its circumference, which groove can be engaged by holding means 15, which in the present example are formed as clips, in the fastened state. The fastened state can be seen in FIGS. 10*b* and 11*b*. In this case, the primary optics 9 is fixedly connected to the second carrier 14. The second carrier 14 may be formed as a separately produced body or also as an element produced with the lens 9 in a casting process.

The use of a remote-phosphor light source 12 of this kind results in the following advantages:

the light emitting surface is impinged homogeneously;

failure of an individual LED likely will not be noticed;

"screen-door imaging" with certain focus positions is prevented (note: with certain focus positions, the individual chips of multi-chip LEDs (or LED arrays) are imaged in the target plane—the imaging in this case assimilates a light-dark grid, particularly if a very large number of individual chips are interconnected to form a planar array;

the conversion layer is separated from the LED chip and therefore from the main heat source;

the dimensions and shape of the components in question may be almost freely selected;

minor spectral adaptation of the light, even with lower quantities (whereby the development of a COB-LED that is suitable for mass production is unnecessary).

The remote-phosphor element 11 is distanced from the LED light sources 3, wherein the LED light sources 3 are enclosed laterally by side walls 16, which, in the assembled state of the remote light source, extend as far as the remote-phosphor element 11. These side walls 16 are highly reflective, and therefore the light emitted by the light sources 3 impinges on the remote-phosphor element 11 with minimal loss.

In addition, it may be provided that the primary optics 9, which is typically formed as a lens, has a free-form lens contour, which is adapted to the geometric shape of the illumination module 1 in such a way that light is emitted by the illumination module 1 as homogeneously as possible and the emitted light cone coincides largely with the geometric shape of the illumination module 1—measured as a normal projection in the light emission direction—, wherein the geometric shape is delimited by the side walls 2*a* and the emission extends as homogeneously as possible as far as the side walls 2*a* and ends thereafter, such that, with a superposition of adjacent light modules, a seamless homogeneous transition of the individual light distributions associated with the light modules may be provided. In other words, the lens is preferably formed in such a way that its outer shape follows the reflector limit: a square reflector requires a lens in which contour elements repeat four times; in the case of a hexagonal reflector, the contour elements repeat six times, etc.

In view of this teaching, a person skilled in the art is able to arrive at embodiments of the present teaching which have not been shown without exercising inventive skill. The present teaching is therefore not limited to the shown embodiment. Individual aspects of the present teaching or of the embodiments may also be selected and combined with one another. Those concepts forming the basis of the present teaching that may be implemented in various ways by a person skilled in the art in the knowledge of this description and yet still remain maintained as such are essential. Any reference signs in the claims are exemplary and serve merely to facilitate the reading of the claims; they do not limit the claims.

The invention claimed is:

1. An illumination module for emitting light directed in parallel in a main emission direction, the illumination module comprising, a reflector with a focus lying on the front side thereof, at least one LED light source; arranged substantially at the focus of the reflector for radiating light into the reflector, and a heat sink arranged on the rear side of the reflector, wherein the LED light source is oriented counter to the main emission direction, wherein the reflector is configured to direct the light radiated into the reflector by the at least one LED light source in parallel and emit said light in the direction of the main emission direction, wherein the at least one LED light source, is held by at least one connecting web extending from the heat sink to the LED light source, the at least one connecting web being designed to conduct heat from the at least one LED light source into the heat sink, and the at least one connecting web thermally contacts the at least one LED light source and the heat sink, wherein the at least one connecting web additionally incudes a member for electrically contacting the at least one LED light source, wherein the front side of the reflector is covered by a transparent protective glass, wherein the at least one LED light source is enclosed between the reflector and protective glass, wherein the reflector is delimited by side faces oriented parallel to the main emission direction and the protective glass extends as far as the side faces, wherein the side faces additionally define the geometric dimensions of the illumination module normal to the main emission direction, wherein the geometric shape of the illumination module is selected in such a way that an arbitrarily extendable form-fitting, area-filling arrangement of illumination modules within a plane is attainable due to a planar arrangement side-by-side and/or above one another of individual illumination modules having the same geometric shape.

2. The illumination module according to claim 1, wherein the at least one connecting web is formed as a metal pipe with cooling liquid received inside the metal pipe.

3. The illumination module according to claim 1, wherein the illumination module has at least two connecting webs, preferably exactly three connecting webs, which extend through the reflector towards the at least one LED light source, wherein the angle which adjacent connecting webs enclose with one another within a virtual plane normal to the main emission direction is the same for all connecting webs.

4. The illumination module according to claim 1, wherein the member for electrically contacting the at least one LED light source is formed by the connecting web itself by forming at least one metal electrical line along the connecting web as part of the connecting web.

5. The illumination module according to claim 1, wherein the member for electrically contacting the at least one LED light source is formed by at least one separate electrical line guided along the connecting web.

6. The illumination module according to claim 1, wherein the heat sink, the reflector, the at least one connecting web and the at least one LED light source form a structural unit.

7. The illumination module according to claim 1, wherein the protective glass and the reflector are sealed with respect to one another, and the at least one connecting web and the reflector are sealed with respect to one another.

8. The illumination module according to claim 1, wherein the at least one LED light source is rigidly connected to the heat sink by the at least one connecting web, wherein the reflector is displaceable in relation to the at least one LED light source along a portion of the connecting web, which portion is oriented in the main emission direction.

9. The illumination module according to claim 8, wherein for displacement of the reflector in relation to the at least one LED light source, the reflector acts on the heat sink by an adjustment screw, by which the reflector is displaceable in the main emission direction.

10. The illumination module according to claim 1, wherein the ratio of maximum LED light emitting surface diagonal to maximum reflector diagonal is at most 1:20.

11. The illumination module according to claim 1, wherein the reflector surface and luminous flux of the LED are selected in such a way that the illumination in the vicinity of the front side of the reflector in a plane normal to the main emission direction is between 50,000 and 150,000 lx.

12. The illumination module according to claim 1, wherein a primary optics is attached to the at least one LED light source, by which primary optics the light distribution emitted by the at least one LED light source is changed.

13. The illumination module according to claim 1, wherein a plurality of LED light sources is provided which are configured to form a common remote-phosphor light source by arrangement of a common remote-phosphor element downstream of the LED light sources, which remote-phosphor element is designed for conversion of the light emitted by the LED light sources, wherein the LED light sources are designed to emit light into the remote-phosphor element.

14. The illumination module according to claim 13, wherein the LED light sources are arranged on a first carrier, and wherein the remote-phosphor element is arranged on a second carrier, and wherein a holder is provided, which is designed for releasable connection of the first carrier and second carrier.

15. The illumination module according to claim 13, wherein the primary optics is fixedly connected to the second carrier.

16. A lighting device, in particular a filming spotlight, for emitting light directed in parallel, the lighting device including a number of illumination modules according to claim 1, wherein adjacent illumination modules border one another form-fittingly.

17. The lighting device according to claim 16, wherein the illumination modules are arranged in the form of a matrix, wherein the matrix has at least n rows and at least m columns, wherein n and m are natural numbers.

18. The lighting device according to claim 16, wherein all illumination modules are arranged two-dimensionally within a plane, wherein the main emission direction of the individual illumination modules is the same.

* * * * *